United States Patent [19]

Vanderline

[11] 4,231,683

[45] Nov. 4, 1980

[54] PROCESS AND A DEVICE FOR MAKING ANCHORAGES IN SOILS AND ROCKS

[76] Inventor: Walpy Vanderline, Rua Miralta, 201, San Paulo, Brazil

[21] Appl. No.: 932,880

[22] Filed: Aug. 11, 1978

[30] Foreign Application Priority Data

Aug. 11, 1977 [BR] Brazil ..... 7707080

[51] Int. Cl.[3] ..... E21D 20/02

[52] U.S. Cl. ..... 405/260; 405/244

[58] Field of Search ..... 405/258, 259, 260, 261, 405/262, 232, 244

[56] References Cited

U.S. PATENT DOCUMENTS

| | | | |
|---|---|---|---|
| 3,936,924 | 2/1976 | Ichise et al. | 405/259 X |
| 3,994,138 | 11/1976 | Herbst | 405/260 |
| 4,056,036 | 11/1977 | Kamann et al. | 405/259 C |
| 4,069,677 | 1/1978 | Yamada et al. | 405/260 |
| 4,112,637 | 9/1978 | Herbst | 405/259 X |
| 4,140,429 | 2/1979 | Herbst | 405/261 |

*Primary Examiner*—Dennis L. Taylor

*Attorney, Agent, or Firm*—Benasutti Associates, Ltd.

[57] ABSTRACT

An improvement in the process and a device for making anchorages in soils or rocks having ringed supports that ensure the armatures arrangement, and where two jackets are coupled, one outside and another inside the cable, are provided with radial and longitudinal injection holes, wrapped up and closed externally by elastic means.

7 Claims, 10 Drawing Figures

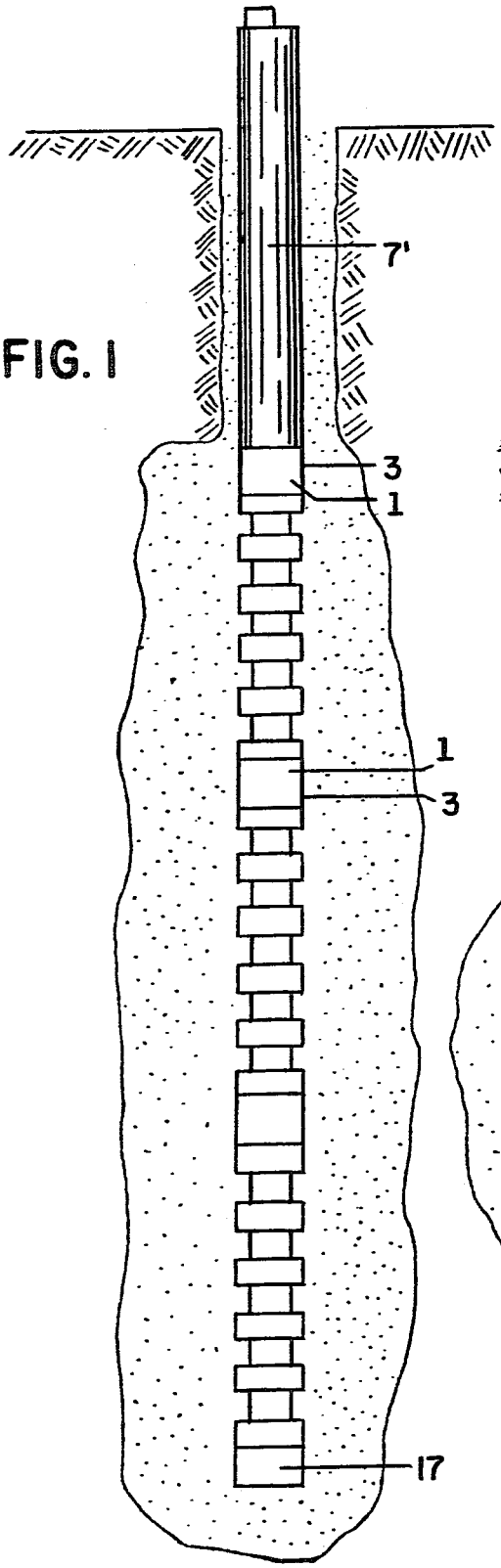
FIG. 1
FIG. 2
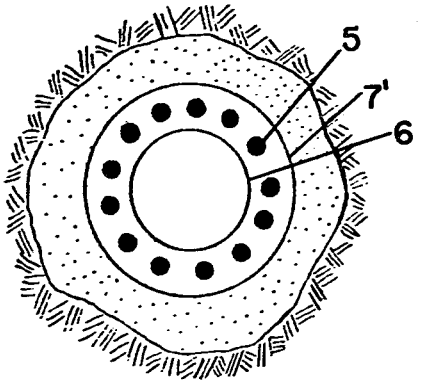
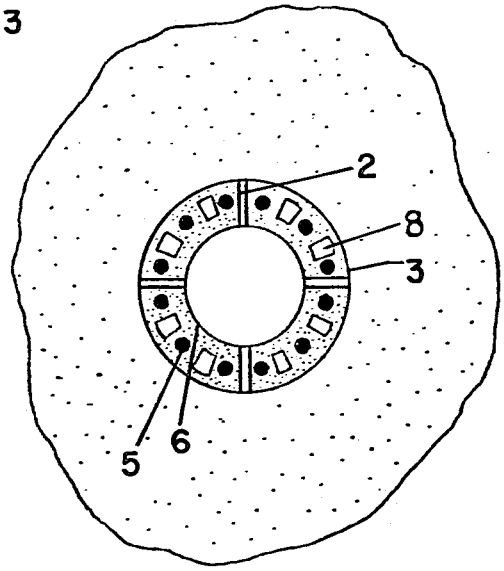
FIG. 3

PROCESS AND A DEVICE FOR MAKING ANCHORAGES IN SOILS AND ROCKS

BACKGROUND OF THE INVENTION

As it is known, the technical word "rod" serves to indicate a structural part, subject to traction or pulling efforts.

The connotation given to this word in the present patent is applied to steel bars, cables and wires, which are introduced into the soil and serve to transfer the applied efforts at one free end or "head", to a sector in the other end, called an anchorage sector, and where the traction forces are transferred through, is called a "free sector".

Thus, the applied efforts on the rod head pass through the free sector and are transferred by means of the anchored sector or anchorage bulb.

The rod head consists of a device for fastening the armature—bars, cables, wires or steel tubes—to the supporting framework.

The anchorage bulb is made up through injection, usually of cement prime, but may be also of resin. When this injection is made by gravitation, this type of rod is called an anchor bolt. The anchor bolts are not further discussed in this application, since the rods described herein are those which have its bulb formed by injection, under pressure.

The rods differ one from another, basically by the
perforation process
type and armature arrangement
device and injection process
head anchorage device The differences relative to the perforation process are not essential for the purpose of this application, since the invention disclosed herein refers to the armature arrangement, in the injection devices and process, and to the complete rod protection.

The rods anchored in the soil or rock or, the anchorages, as they are usually called, have several usages in engineering, such as:

slope stabilization
staying of walls subject to thrusts
fastening of frameworks subject to a secondary force
fastening of vaults or tunnel walls
fastening of concrete dams
fastening of transmission towers from a electrical network and others.

The making of rods faces, up to the present technical level, the challenge of its basic desideratum: that is, to introduce an armature into the soil which, by its very nature, must be protected against the environment agressivity, and later on, subject this armature to a certain pulling out effort.

The problem consists in trying to avoid, not only the direct contact of the rod armature with the agressive environment, in order to preserve it against corrosion, but also to provide a complete steel protection, in the long run.

This problem is even more difficult to solve, when one knows that such protection cannot avoid the formation of a great amount of friction soil/cement, that serves as a basis for the anchorage.

For this purpose, the prior art processes and apparatuses may be grouped, as follows:

1st group—BAUER system

TUBFIX system (injected tubular anchorages) - SUISSBORING

2nd group—SOLETANCHE

In the 1st group, are the main systems, which are characterized by the inclined point of the perforation rod.

TUBFIX—The TUBFIX anchorage, from Suissboring Co., consists in introducing into the soil, an adequate tube by rotation, so that the crown is lost in the soil and constitute, together with tube, the rod armature.

The lower part of the tube—or anchorage sector—is perforated and "inlaid", allowing the injection liquid to flow out, to form the bulb.

The protection of the tubular armature is made by means of galvanization.

BAUER—The BAUER procedure, of German origin, consists in introducing a tube, having inside a steel bar of high strength, through a lost point, which guides the tube.

The bulb injection is done at the same time as the tube is extracted, the injection flowing out by the end and through the ringed gap between the tube and the steel shaft.

The free sector is protected by means of a plastic sheath.

To the 2nd group belongs the anchorages made up of wires (or even cordages) placed around a central tube, whose main representative is the rod type SOLETANCHE.

SOLETANCHE—In this system, the ringed gap among the wires is occupied by an internal tube lost and blind in the free sector and provided with holes in the anchorage sector, where from the injection liquid flows out, to form the bulb. These holes are closed by "inlaids"—which surround the sheaf which prevent the liquid flowing back inside the tube.

A secondary operation closes the tube above and under each inlaid, injecting the liquid under pressure, which "bursts" the inlaid, and fills the gap between the rod and the soil.

The free sector remains protected by a plastic sheath.

Certain disadvantages peculiar to each of the above systems are stated as follows:

TUBFIX—The tubes junctions, whether by sleeve or welding, is a critical point, that cannot remain ignored and must receive special care, like traction tests, welding survey, etc.

On the other hand, the tube protection by galvanization increases the cost of the rod, rendering it very expensive.

BAUER—The possibility of introducing an anchorage type BAUER is restricted to soils without cohesion (sandy soils, rough soils, without blocks or obstacles).

In all other cases of cohesive soils (as clay, argilite or sandy soils) the use of BAUER type rods, is subject to the following procedure:

Making of a rotative perforation, with a diameter greater than necessary, for the rod installation:

Filling of hole with sand (gross).

This procedure have (among other) the disadvantage of making expensive the cost of rods.

SOLETANCHE—The anchorage sector cannot protect entirely the rod steel.

Usually, the introduction of the rod in holes, where there is no danger of collapsing of the walls, makes the coating unnecessary. In this case, we can't avoid the armature touching the ground, mainly in the case of tilted or horizontal rods: when placed, the rod touchs the ground with its point and/or with its spacers and the material so removed, stays among the wires.

This could be avoided, if we use systematically the covering tube for introducing the rod, taking it out some time after the injection; as a matter of fact, this procedure is usual only in holes subject to falling down.

Even with this careful procedure, there remains the danger of the direct contact steel and ground, for, when removing the covering, the injection overflowing, not yet hardened, will have the tendency of flowing to the space occupied by the tube wall, leaving the flowing column, which is supported by the spacers.

Some technics use the system of increasing the covering thickness of the armature, by means of spacers, taking the risk of two main inconvenients:

(a) the greater the spacer, the greater the base for the flowing column, and greater the column weight right down, and so, greater the tendency to separation;

(b) the increase in the perforation cost, due to the increase of spacers diameter.

in Brazilian Pat. No. 7019728, the applicant aimed the protection of the new process and device for making rods anchored in soils or rocks, and even, if for eventual reinjections, the operation should end by the washing of the inside chambers of the device, by water flowing, the above mentioned inconveniences, have been overcome with the improvements.

Further, a grooved tube of permanent material, placed in the anchorage sector, in order to provide the weight transfer from the rod armature to the soil, and provide also and additional protection of the steel against corrosion, due to the passage of cemente mud, according to the present standards.

The technique, now improved, is based upon the erection of an anchorage, through injection and repeated injections, all under pressure, of cement mud or chemical products, in the soil or rock.

SUMMARY OF THE INVENTION

The rod armature is made up, basically, by a set of steel wires or cordages, and may also be formed by a steel tube or, by one or two shafts. Those formed by cordages, are placed parallel and concentric, forming a cable.

In the anchorage sector, the armature arrangement is ensured by means of ringed supports, to which two jackets are coupled, outside and inside the cable. Said supports have radial and longitudinal injection holes, closed externally by elastic means.

In the free sector, the anchorage arrangement is also ensured by simple spacers.

BRIEF DESCRIPTION OF THE DRAWINGS

FIG. 1—shows a side view of a rod, mainly an anchorage sector thereof, characterized by the tubular protection jacket, divided in sectors by ringed supports, above which is shown a free sector, characterized by a flat tube.

FIG. 2—shows in cross section, the free sector spacer;

FIG. 3—shows also, a schematic cross section in the middle of the ringed support;

DETAILED DESCRIPTION OF THE DRAWINGS

The following is a description of each one of the elements shown in this set of drawings, and the way the combination of such elements can provide the improvements that represent the objective of this invention.

Figure 4:
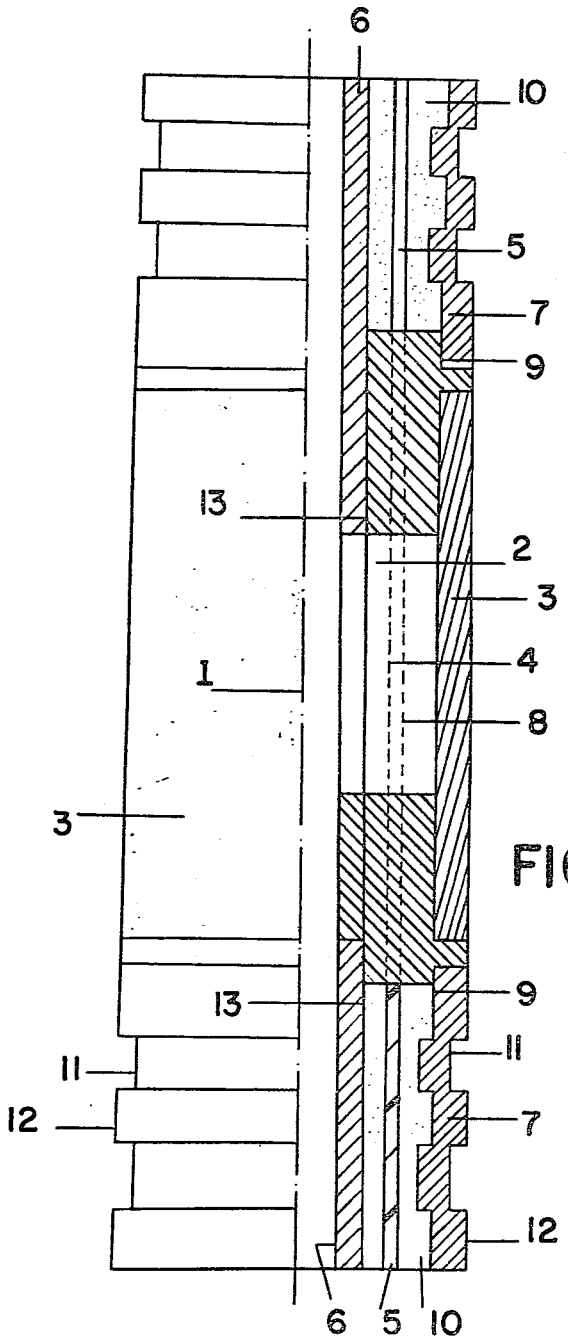
FIG. 4—shows the elements that form the intermediate ringed supports of the anchorage sector.

We will consider first the intermediate ringed support 1 of the anchorage sector, seen in FIG. 4.

This part has, preferably, a cylindrical shape, and may also have, therefore any prismatic form.

In the outside, it is adjusted:

(a) the protective tubular jacket 7 through groove 9;

(b) and the elastic mean 3.

Inside, it is found the internal jacket 6, adjusted to the ringed groove 13.

In the support body, are found the radial holes 2 and the longitudinal holes 4, without communication.

Figure 5:
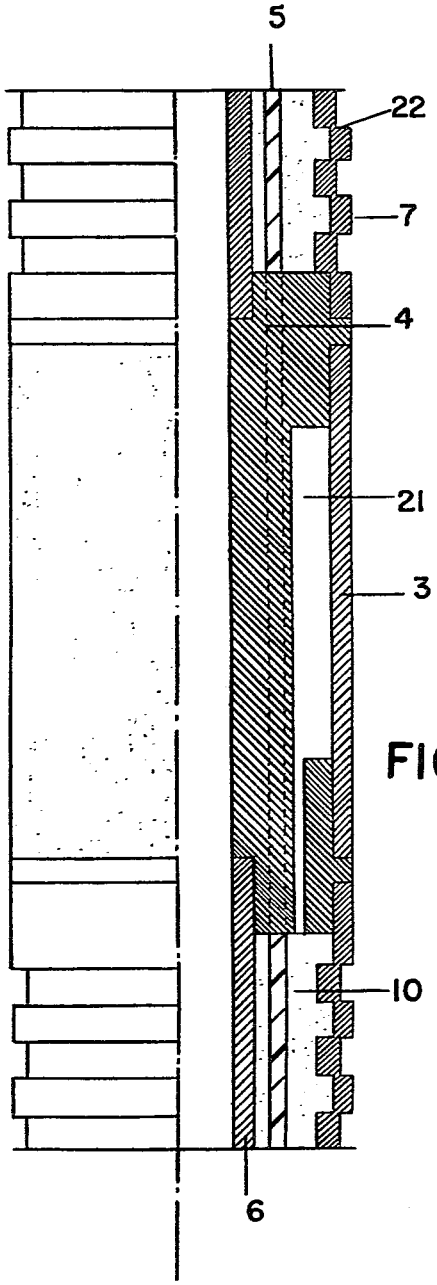
FIGS. 5 and 6—show, respectively, a ringed support interrupter in the upper end of the anchorage sector and which separates the same from the free sector and the lower ringed support, situated in the rod's end and where rests the armature.

The ringed support of the upper end of the anchorage sector that separate the free sector from the anchorated sector (FIG. 5) is different from the ringed support intermediate only by the fact that it does not have the radial hole 2 and is provided with hole 21, which allows the passage of injection from the compartment 10 to the external part of the rod, not allowing any communication between holes 21 and 4.

Figure 6:
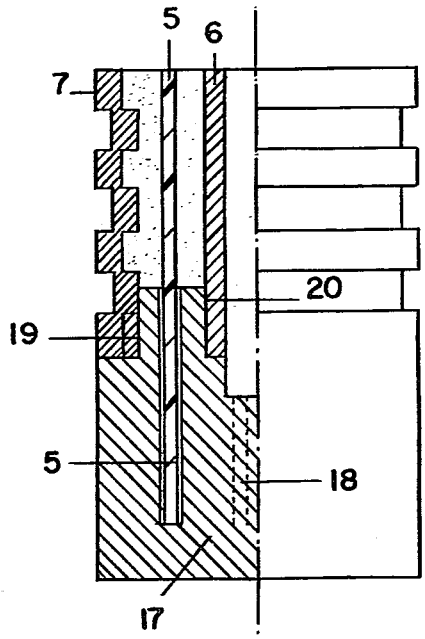
Figure 7:
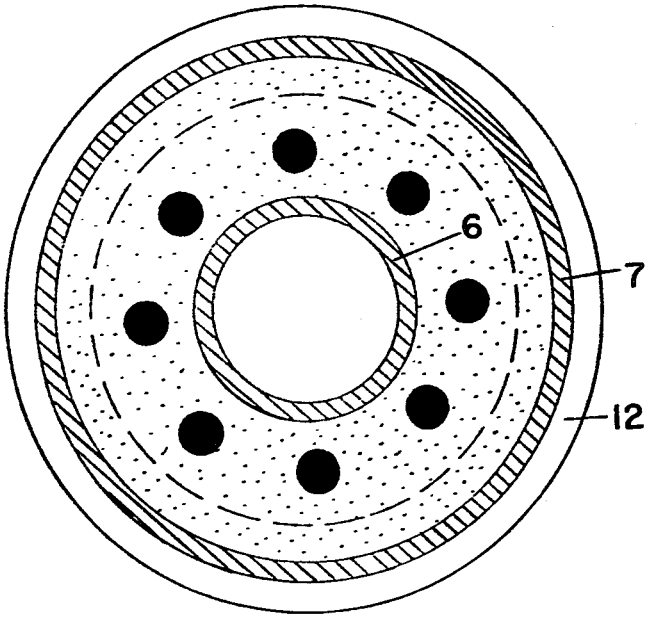
FIGS. 7 and 8 show, respectively, the cross sections of the anchorage sector and of the intermediate ringed support of the anchorage area.
Figure 8:
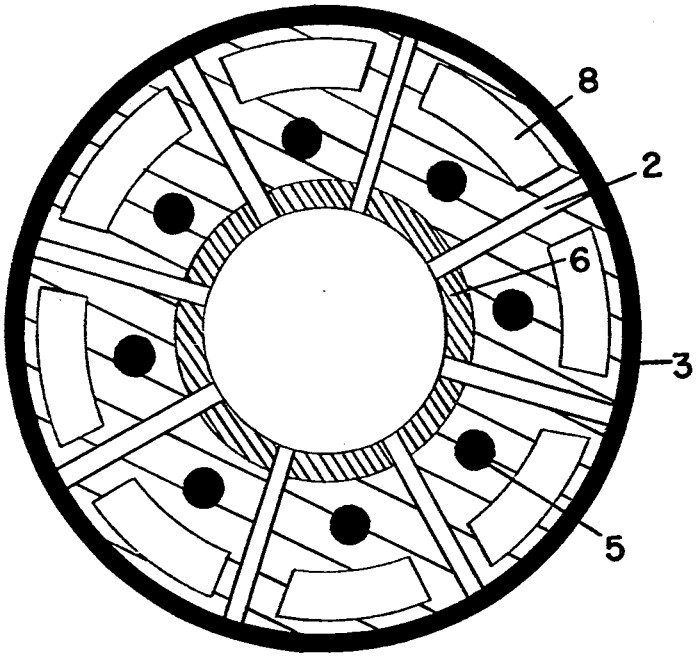

Finally, the ringed support of the lower end of the rod, seen in FIG. 6, is provided with:

(a) holes 18, that serves to protect the wires ends;

(b) ringed grooves 19 and 20, to receive the two jackets: tubular protective 7 and internal 6.

The above description has been made in order to explain the nature of this invention and it should be noted that, these parts may have several other shapes, without departing from the basic idea.

Let us see now, the erection process of said rod.

First, the ringed supports and jackets are put in the bench, without adjusting it to the supports.

Then, the wires are introduced in the longitudinal holes of the supports, and the jackets are adjusted to the respective supports.

After assembling the rod, the internal injection is carried out, and may be done either in the bench or in the hole itself.

Figure 9:
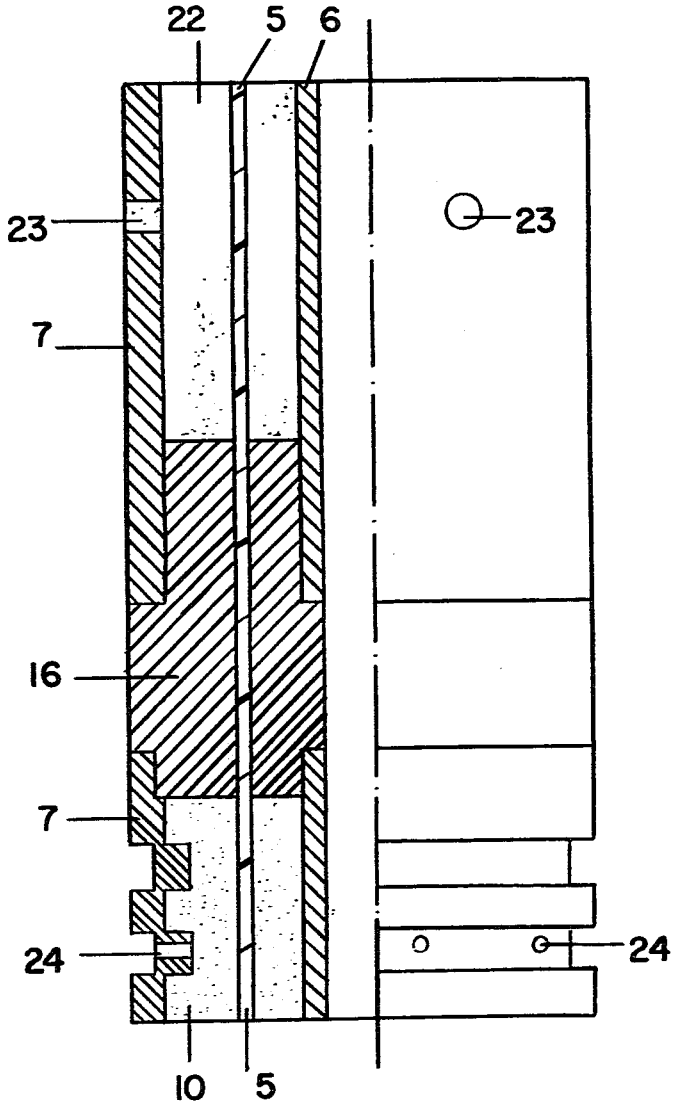
FIGS. 9 and 10 show, respectively, a device for the direct injection of the internal part, when performed on the bench, and an injector tube.

In the case of injection on the bench, the device of FIG. 9 is used, which allows injection into the compartment 22 of the free sector through hole 23 and the compartment 10, of the anchorated sector, from hole 24.

Figure 10:
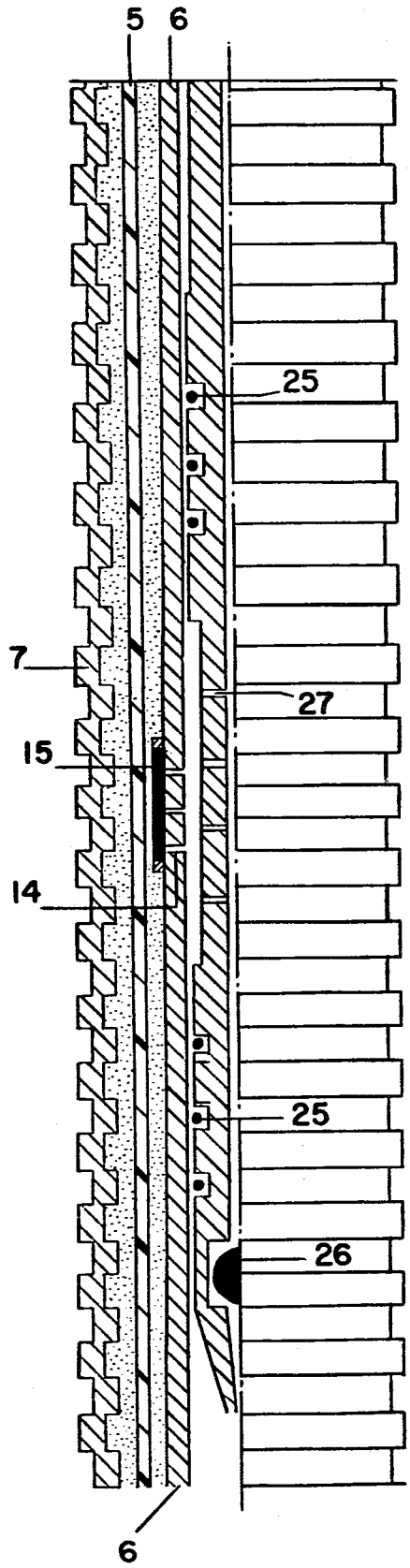

When the rod injection is done in the hole itself, the injector tube seen in FIG. 10 used. This tube is provided with a sector of radial holes 27, limited above and below, by sealing rings 25 and a retention valve 26, placed on its end, in order to allow the air admission and/or eventually, of water existent in the hole. Thus, the injection flow cross the holes 27 of the injector tube, the holes 14 of the internal jacket, involved and closed by the elastic means 15, towards the compartment 10 and from there, to the outside of hole 21, of the interrupter ringed support and the elastic means 3.

Then, starts the injection to form the anchorage bulb.

This is possible, by means of the ringed support 1. The injector tube is placed in such a way, that the position of the ringed support is made even with the perforated sector of the injector tube. The injection flow, called primary injection, that comes from the injector tube passes through the hole 7, towards the outside, by the elastic mean 3.

When the hole is completely full, the primary injection is finished and we wait the hardening of the material injected.

Then, we reinject the same, under adequate pressure, making the injector tube to pass successively, by all supports. This operation can be repeated, how many times it will be necessary.

The injection of the free sector can be done by an identical procecedure as for the internal injection, or by the hole opening.

This system allows repeated injections at any time, even keeping the wires stretched.

Thus, during the stretching phase, the specified load has not been reached, and we can avail of the expedient of reinjecting the bulb of anchorage, and this will be possible how many times it will be necessary.

Owing to the material examined to fulfill the gaps of the free sector, further tests of the tensile condition of wires can be done, easily.

The technique shown in the present patent, allows still the erection of rods in any type of soil, with less diameter.

The type of armature used, allows the making of rods in any length, without weldings, sleeves.

The rod armature does not contact the soil, nor the soil water, being ensured its complete protection against corrosion.

The materials that form the rod are all of domestic making and easy to buy in the market, and the rod is cost saving.

This type of rod allows also a rigorous quality control, reaching a high perfection, under all aspects.

I claim:

1. An apparatus for providing an anchorage for fastening a rod to soils, rocks or the like, said apparatus comprising an elongate anchorage sector and a free sector attached to one end of said anchorage sector, said anchorage sector comprising an upper ringed support member adjacent said free sector, a lower ringed support member and at least one intermediate ringed support member disposed therebetween, adjacent ringed support members being connected by a hollow tubular internal jacket and a hollow tubular external jacket disposed around said internal jacket, said jackets defining a tubular compartment therebetween, said intermediate ringed support member comprising:

(a) a top portion, a bottom portion and a substantially cylindrical inner passage extending therebetween, said inner passage having a cross sectional area which is substantially co-extensive with and in communication with the hollow portion of said internal jacket whereby a longitudinal internal passage is formed which extends along substantially the length of said anchorage sector;

(b) at least one radial injection passage extending between said inner passage and an external surface for providing fluid communication between said longitudinal internal passage and the exterior of said anchorage sector, said external surface having an elastic means disposed thereon at least in the vicinity of and covering said radial injection passage;

(c) at least one longitudinal opening, extending between said top and bottom portions, adapted to receive a wire therethrough; and (d) at least one longitudinal injection passage extending between said top and bottom portions for providing fluid communicaton between adjacent compartments, said longitudinal opening, said radial injection passage and said longitudinal injection passage being non-communicating.

2. The invention of claim 1 wherein said upper ringed support member further comprises at least one radial injection passage extending between a bottom portion and an external surface for providing fluid communication between the adjacent tubular compartment and the exterior of said anchorage sector, said external surface having elastic means disposed thereon at least in the vicinity of and covering said radial injection passage.

3. The invention of claim 1 wherein said external jacket includes grooves and projections on an exterior surface thereof.

4. The invention of claim 1 wherein said internal jacket includes at least one aperture therein for providing fluid communication between said longitudinal internal passage and said tubular compartment, said internal jacket having elastic means disposed on an exterior surface thereof at least in the vicinity of and covering said aperture.

5. The invention of claim 1 wherein said lower ringed support member includes a base member having at least one opening in a top portion thereof, said opening being in communication with said tubular compartment and adapted to receive an end of the wire therein.

6. The invention of claim 2 wherein said upper ringed support member additionally comprises a ringed interrupter adjacent said free sector for isolating said tubular compartment from a free sector compartment formed by a tubular free sector external jacket disposed around a tubular free sector internal jacket, said ringed interrupter having at least one passage therethrough adapted to receive a wire therein, said external jacket including at least one aperture therein for providing fluid communication between the tubular compartment and the exterior of said anchorage sector, and said tubular free sector external jacket having at least one aperture therein for providing fluid communication between the free sector compartment and the exterior of said free sector.

7. The invention of claim 1 wherein said apparatus further comprises a hollow injector tube adapted for insertion into said longitudinal internal passage, said injector tube comprising:

(a) check valve means in a lower end thereof;

(b) a cylindrical injection cavity formed by a groove in an external surface thereof;

(c) at least one aperture for providing fluid communication between the hollow interior of said injector tube and the injection cavity; and, (d) circumferential sealing means above and below said injection cavity for substantially confining injection fluids within said injection cavity.

* * * * *

UNITED STATES PATENT OFFICE

CERTIFICATE OF CORRECTION

Patent No. 4,231,683 Dated November 4, 1980

Inventor(s) Walpy Vanderlinde

It is certified that error appears in the above-identified patent and that said Letters Patent are hereby corrected as shown below:

Under the heading "United States Patent" change "Vanderline" to "Vanderlinde".

After "Inventor:" change "Walpy Vanderline" to "Walpy Vanderlinde".

Under "Foreign Application Priority Data" change "Brazil ..... 7707080" to "Brazil ..... 7705314".

Signed and Sealed this

*Fourteenth* Day of *July 1981*

[SEAL]

*Attest:*

GERALD J. MOSSINGHOFF

*Attesting Officer*

*Commissioner of Patents and Trademarks*